US006191680B1

(12) United States Patent
Hofsäss

(10) Patent No.: US 6,191,680 B1
(45) Date of Patent: Feb. 20, 2001

(54) SWITCH HAVING A SAFETY ELEMENT

(76) Inventor: Marcel Hofsäss, Höfener Strasse 29, 75305 Neuenbürg (DE)

( * ) Notice: Under 35 U.S.C. 154(b), the term of this patent shall be extended for 0 days.

(21) Appl. No.: 09/248,512

(22) Filed: Feb. 10, 1999

(30) Foreign Application Priority Data

Feb. 23, 1998 (DE) ..... 198 07 288
Aug. 17, 1998 (EP) ..... 98115406

(51) Int. Cl.[7] ..... H01H 37/52; H01H 37/54; H01H 37/60

(52) U.S. Cl. ..... 337/362; 337/333; 337/365; 337/372

(58) Field of Search ..... 337/333, 404, 337/405, 407, 416, 324, 377, 362, 388, 389, 397, 342, 343, 365, 372, 375, 380, 390, 391, 36, 52, 53, 85, 89, 100–102, 131, 135, 141

(56) References Cited

U.S. PATENT DOCUMENTS 533,183 * 1/1895 Storrs ..... 337/404
1,894,746 * 1/1933 Johnson ..... 337/403
2,300,142 * 10/1942 Wood ..... 337/164
3,309,481 * 3/1967 Merrill ..... 337/403
3,827,014 * 7/1974 Wehl ..... 337/407
3,870,985 * 3/1975 Hire ..... 337/381
4,124,835 * 11/1978 Cahill, Jr. ..... 337/1
4,319,214 3/1982 Givler .
4,389,630 6/1983 Ubukata et al. .
4,433,231 * 2/1984 Balchunas ..... 219/253
4,472,705 * 9/1984 Carlson ..... 337/299
4,527,144 * 7/1985 Arikawa ..... 337/407
4,536,641 * 8/1985 Chan ..... 219/253
4,636,766 1/1987 Carbone et al. .
4,720,905 * 1/1988 Bibeault ..... 29/446
4,862,132 * 8/1989 Hollweck ..... 337/102
4,862,133 * 8/1989 Tabei ..... 337/102
4,885,560 12/1989 Niino .
5,196,820 3/1993 Ubukata et al. .
5,221,914 6/1993 Ubukata et al. .
5,309,131 * 5/1994 Hofsass et al. ..... 337/102
5,367,279 * 11/1994 Sakai ..... 337/104
5,607,610 * 3/1997 Furukawa ..... 219/505

* cited by examiner

*Primary Examiner*—Leo P. Picard
*Assistant Examiner*—Anatoly Vortman
(74) *Attorney, Agent, or Firm*—Harness, Dickey & Pierce, P.L.C.

(57) ABSTRACT

A switch (10') has one first and at least one second external terminal (11, 14) as well as a temperature-dependent switching mechanism (19) that makes, as a function of its temperature, an electrically conductive connection between the two external terminals (11, 14) for an electrical current to be conducted through the switch. The switching mechanism (19) has a switching member (22) which changes its geometrical shape between a closed position and an open position as a function of temperature and, in its closed position, carries the current flowing through the switch (10'). The switching mechanism (19) further has a spring element (21) which is permanently connected electrically and mechanically in series with the switching member (22). When a given safety temperature is exceeded for the first time, a safety element (37) keeps the switch in its open condition, irrespective of its subsequent temperature.

20 Claims, 5 Drawing Sheets

SWITCH HAVING A SAFETY ELEMENT

BACKGROUND OF THE INVENTION

1. Field of the Invention

The present invention relates to a switch having one first and at least one second external terminal as well as a temperature-dependent switching mechanism that makes, as a function of its temperature, an electrically conductive connection between the two external terminals for an electrical current to be conducted through the switch, the switching mechanism comprising a switching member which changes its geometrical shape between a closed position and an open position as a function of temperature and, in its closed position, carries the current flowing through the switch. The switch further comprises an actuating member which is permanently connected electrically and mechanically in series with the switching member.

2. Related Prior Art

A switch of this kind is known from U.S. Pat. No. 4,636,766 A.

The known switch comprises, as the switching member, a U-shaped bimetallic element having two legs of different lengths. Attached to the long leg is a movable contact element which coacts with a switch-mounted countercontact that in turn is connected in electrically conductive fashion to one of the two external terminals.

The shorter leg of the U-shaped bimetallic element is attached to the free end of an actuating member configured as a lever arm, which at its other end is joined immovably to the housing and is connected in electrically conductive fashion to the other of the two external terminals. The actuating member is a further bimetallic element which is matched to the U-shaped bimetallic element in such a way that when temperature changes occur, the two bimetallic elements deform in opposite directions and thus maintain the contact pressure between the movable contact element and the housing-mounted countercontact.

This switch is intended as an interrupter for high currents, which cause considerable heating of the bimetallic element through which current is passing, thus ultimately lifting the movable contact element away from the fixed countercontact. Ambient temperature influences are compensated for, in this context, by the aforementioned opposite-direction deformation of the bimetallic elements.

The principal disadvantage of this design is that two bimetallic elements are required, the temperature characteristics of which must be exactly matched to one another; this is physically complex and cost-intensive to implement. In order to compensate for production tolerances, the known switch is moreover mechanically adjusted after assembly, which constitutes a further disadvantage.

Since the two bimetallic elements are of geometrically very different design, they also have different long-term stabilities, so that readjustment would in fact be necessary from time to time. This is, however, no longer possible during use, so that long-term stability and thus functional reliability generally leave much to be desired.

A further disadvantage of this design consists in the large overall height resulting from the U-shaped bimetallic element.

The known current-dependent switch is thus of complex design, expensive, and not very reliable.

A further current-dependent switch known from EP 0 103 792 B1 has as the switching member a bimetallic spring tongue which is attached to the one external terminal and at its free end carries a movable contact element which coacts with a countercontact that is arranged at the free end of an elongated spring element that is attached at the other end to the other external terminal. The switch is connected with its external terminals in series with an electrical device in such a way that the operating current of that switch flows through the bimetallic spring tongue. As a rule, the known switch is moreover thermally coupled to the electrical device, so that it can follow its temperature changes.

If the temperature of the device now rises above an impermissible value, the bimetallic spring tongue lifts the movable contact away from the countercontact, thus interrupting the flow of current and preventing the electrical device from heating up further. The bimetallic spring tongue can also, however, be brought into this open position by an increased flow of current, since the bimetallic spring tongue heats up due to the electrical current flowing through it. The electrical properties of the bimetallic spring tongue can be set, in coordination with the mechanical properties and the kickover temperature, in such a way that it is in its closed position, in which it conducts the operating current of the electrical device, when the ambient temperature is below the switching temperature and the operating current is also below a response current intensity. If the operating current then rises above the permissible value, the bimetallic spring tongue heats up very rapidly and reaches its kickover temperature, whereupon it transitions into its open position.

This switch thus offers protection from both overtemperature and overcurrent.

Because of the elastic mounting of the countercontact, the contact and countercontact rub against one another during switching operations, so that contaminants and deposits are rubbed off the contact surfaces, ensuring a low contact resistance and thus a good electrical connection. The elastic mounting of the countercontact furthermore ensures low mechanical loading of the bimetallic spring tongue, since the countercontact yields to a limited extent. This prevents irreversible deformations of the bimetallic spring tongue. Since mechanical deformations of this kind can lead to a shift in the switching temperature, the overall result of this arrangement is to ensure high operating reliability.

A disadvantage with this known switch, however, is that because of the elastic deflection of the countercontact and the kickover of the bimetallic spring tongue into the open position, it requires a relatively large amount of space for the switching function of the temperature-dependent switching mechanism. A further disadvantage is the fact that during the transition from the closed position into the open position, the bimetallic spring tongue—like all bimetallic elements—passes through a so-called "creep" phase in which the bimetallic element deforms in creeping fashion as a result of a rise or drop in temperature, but does not snap over from its, for example, convex low-temperature position directly into its concave high-temperature position. This creep phase occurs each time the temperature of the bimetallic element approaches the kickover temperature from either above or below, and leads to appreciable changes in conformation. The creep characteristics of a bimetallic element can moreover also change even further as a result, particularly, of aging or long-term operation.

During the opening movement, creep can cause the pressure of the contact against the countercontact to weaken, thus leading to undefined switching states. During the closing movement, the contact can gradually approach the countercontact during the creep phase, thus possibly creating the risk of arcing.

These problems associated with the creep behavior of a bimetallic element are solved, in the case of a current-dependent switch as described in the aforementioned U.S. Pat. No. 4,636,766, in U.S. Pat. No. 4,389,630, or in EP 0 103 792, by the fact that the bimetallic spring tongue is equipped with dimples which do not suppress the creep phase completely, but do suppress it for the most part. These dimples or other mechanical actions upon the bimetallic element are complex and expensive features which moreover greatly reduce the service life of these bimetallic elements. A further disadvantage of the requisite dimple may be seen in the fact that not only different material compositions and thicknesses, but also different dimples, must be used for various performance classes and response temperatures.

In all the switches known from the prior art described so far, the creep phase is thus kept as short as possible, increasing or compensating pressure as well as additional dished portions being used for the purpose.

In all the switches described so far it is further felt to be a disadvantage that they will close again, even after having been strongly overheated, when the temperature drops again below the switching temperature. Such re-closing is in part prevented, according to the prior art, by the fact that a heating resistor is connected in parallel to the switching mechanism, which heating resistor carries a residual current when the switch is in its open position so that it will heat up so far that the bimetallic element remains above its response temperature. This function is known as self-holding effect. However, when the operating current is switched off completely, then such a switch will of course also cool down and go into its closed condition.

More recent safety demands require, however, that when a safety temperature above the snap-over temperature is exceeded, the switch should remain permanently open, regardless of any residual current.

Generally, a switch of this kind has been known from U.S. Pat. No. 4,885,560 A1 which describes a current-dependent switch comprising a bimetallic snap disk that carries two movable contacts each coacting with a fixed countercontact. Below its switching temperature, the bimetallic snap disk thus connects two external terminals that are connected with the fixed countercontacts. When the bimetallic snap disk heats up above is switching temperature, due to an excessively high current, then it lifts both movable contacts off the fixed countercontacts thereby breaking the circuit.

The bimetallic snap disk is fitted in this case centrally on an adjusting screw, and is pressed by a compression spring against the head of the adjusting screw. The head is fixed on the adjusting screw as such by means of fusible solder which will liquefy when a given safety temperature above the normal response temperature of the bimetallic snap disk is exceeded, whereupon the compression spring will urge the bimetallic snap disk away from the adjusting screw whereby the switch is opened in irreversible fashion.

Compared with the other switches discussed so far, this switch provides the advantage that an additional safety mechanism becomes active in the event an overheating condition should occur due to a high current flow with the result that the movable contacts get welded to the fixed countercontacts. If such welding should occur, the displacing force of the bimetallic snap disk would no longer be sufficient to lift the movable contacts off the fixed countercontacts, whereas the pressure of the compression spring still would be, because once the fusible solder has liquefied, there would be no other counteracting force.

The compression spring used must be very strong to ensure that the welded contacts will be safely re-opened. In normal operation, the high force of the compression spring acts centrally upon the bimetallic snap disk, the other side of which rests against the head of the adjusting screw, which is secured in its position by fusible solder. So, a very high mechanical pressure is exerted upon the center of the bimetallic snap disk, which has a negative effect on the service life and the reproducibility of the switch point.

A further disadvantage lies in the fact that in order to prevent contact blinking, the bimetallic snap disk must be provided with deep dimples so as to suppress the creeping phase.

SUMMARY OF THE INVENTION

In view of the above, it is an object of the present invention to provide a current-dependent switch of the kind mentioned at the outset in which excellent operating reliability and long service life are achieved with an economical and simple design.

In the case of the before-mentioned switch this object is achieved, according to the present invention, in that the switch comprises a safety element which, when a given safety temperature is exceeded for the first time, keeps the switch in its open condition irrespective of its further temperature.

The object underlying the invention is completely achieved in this fashion.

This is because the inventor of the present application has recognized that a safety element can be used also in the generic switch to keep the switch permanently in its open condition when a given safety temperature is exceeded in a single instance. Although welding of the contacts is not probable in the case of the generic switch, the use of a safety element may still provide unexpected advantages with respect to a temperature increase not caused by an excessively high current flow.

In this connection it is especially preferred if the switching member comprises a spring element whose displacing force is largely temperature-independent, and if the switching member has a temperature-dependent displacing force higher, in its creeping phase, than the displacing force of the spring element.

The inventor of the present application has recognized that the mechanically and electrically parallel arrangement, known from DE 21 21 802 C, of the temperature-neutral spring element and the switching member can be modified into an electrical and mechanical series circuit and can be used in the generic switch in order to combine a number of advantages in the new switch thus created.

Arranging the spring element and switching member electrically in series results in a current-dependent switch, since the switching member, which preferably is a bimetallic element or a trimetallic element, can heat up very rapidly because of its low thermal mass in the event of excessive current flow or even brief current spikes. Because of the mechanical series arrangement, i.e. the fact that the spring force of the spring element coacts with that of the switching member, the creep phase of the switching member can moreover be compensated for. When the geometry of the switching member changes during the creep phase, this is immediately compensated for by the spring element. It is thus possible for the first time to make possible a long creep phase for the switching member even in a so-called current-dependent switch, since the spring element can compensate for the "undesired" geometrical changes during the creep phase. This means, however, that a more easily produced and thus more economical switching member can be used, which moreover has a greater service life, since the dimple can be dispensed with and a greater hysteresis is permissible, so that the creep phase can be maximally utilized.

The result is to place not only lesser geometrical requirements on the switching member, but also lesser demands on the spring element, since the latter must now merely ensure that below its kickover temperature, i.e. during the creep phase, the switching member remains in electrical contact with one of the external terminals. Switch models which differ in terms of performance class and response temperature can now be designed with substantially the same spring element but different switching members; as already mentioned, the geometrical and mechanical conditions for these components of the switching mechanism are much less stringent, so that they are altogether easier and more economical to produce.

With the new switch, greater emphasis in general can be placed on electrical properties and switching temperature; with the new switch, for the first time in the art, the mechanical spring force of the switching member plays a subordinate role, since it needs to be only so great that the switching member is not excessively compressed by the spring element. The switching operation itself is caused, after the completion of the creep phase, by the switching member alone, which is now always preloaded in its closed position. This preloaded switching member has a number of further advantages: for example, it does not vibrate in a magnetic field and presents no risk of arcing, since the preload prevents the contacts from opening or closing gradually.

Only a very small dimple in the bimetallic element is therefore now required, which simply has to guarantee the snap effect for abrupt contact separation. A larger dimple, as used hitherto to enhance or suppress the creep phase, is no longer necessary. Mechanical stresses are thus reduced, and the service life and the reliability and reproducibility of the switching point are greatly increased.

The temperature-neutral spring element no longer exerts on the bimetallic element any pressure which inhibits its deformation; instead, in the creep phase, it compensates for the deformation of the bimetallic element by its own deformation, in such a way that the movable contact element and fixed countercontact remain securely in contact with one another so as to ensure a low contact resistance; below the switching temperature, the contact pressure remains constant, largely independent of temperature.

The creep phase of the bimetallic element is thus no longer suppressed as in the prior art, but rather, so to speak, compensated for, the reason being that in the creep phase, the bimetallic element can deform in almost unimpeded fashion, changes in the geometry being compensated for by the spring element in such a way that the switch remains securely closed.

For this purpose, the temperature-dependent displacing force of the bimetallic element is selected so that in the creep phase it is greater than the largely temperature-independent displacing force of the spring element, which thus merely "guides" the accordingly "rigid" bimetallic element.

One great advantage of the new switch lies in its simple design: all that is needed besides the housing-mounted countercontact is a bimetallic element, while the spring element is temperature-neutral and thus economical. Overall, the bimetallic element and spring element do still need to be matched to one another in terms of displacing force, but no longer additionally matched in terms of their temperature characteristics, since the switching mechanism adjusts itself, so to speak. This design moreover makes it possible to achieve a low overall height; a new individual adjustment is not required for different switching temperatures, and the bimetallic element simply needs to be designed with the same spring characteristics but different switching temperatures.

A further advantage lies in the fact that tolerances and fluctuations in the switching temperature are compensated for by way of the guidance by the temperature-neutral spring element.

Special advantages are achieved in this case with respect to the safety element provided according to the invention, which preferably consists in a compression spring acting on the actuating member, the compression spring being further operatively arranged between the counter contact and the switching element; preferably it assumes its compressed condition before the safety temperature is exceeded for the first time, and is retained in this position by a fusible solder that will liquefy when the safety temperature is reached, thereby permitting the compression spring to relax.

This structure ensures that neither the switching member nor the actuating member are influenced at all by the compression spring in normal operation, below the safety temperature, so that in addition to the lesser preloading, the absence of any loading by the safety element constitutes an additional important advantage of the new switch.

Neither the service life nor the operating reliability of the new switch are, therefore, impaired by excessive additional dimples or mechanical loading by a safety element. Another advantage is achieved in certain applications by the fact that the force of the compression spring can be much lower, compared with the force of the known compression spring, so that the demands to be placed on the fusible solder and/or the reliability of the connection established by the fusible solder can be clearly lower than in the prior art. This contributes toward increasing the service life and operational reliability because due to its high force the compression spring known from U.S. Pat. No. 4,885,560 A1 may, in the case of certain mechanical vibrations and temperatures near or above the safety temperature cause the head to be pushed off the adjusting screw unwantedly and prematurely. In the case of the new switch according to the invention, the compression spring is, however, only required to act against the force of the spring element so that reduced force and, thus, safe holding below the safety temperature are rendered possible.

In a development, it is preferred if the spring element is joined at its first end to the first connection element and at its second end to the switching member; in its closed position the free end of the switching member is preferably pressed by the spring element against a countercontact joined to the second connection element, and in its open position its free end lifts away from the countercontact, which in further preferable fashion is arranged integrally with the switch; also preferably, the switching member carries at its free end a movable contact element which coacts with the countercontact.

These features, individually and in combination, first of all make available a very simple physical design for the new switch. The permanent join between the switching member and spring element eliminates the disadvantages associated with placement of the loose bimetallic snap disk. A further advantage consists in the fact that no additional insulation is needed; when the contact element has lifted off from the countercontact, there is no risk of an unintended current path. A further advantage is the fact that in its open position, the switching member is not exposed to any mechanical stresses, which increases the long-term stability of the new switch. The result, however, is also that no bracing of the switching member against the cover, etc.—by way of, for example, support nipples—is necessary, thus making possible a planar cover and/or base, which was not the case with existing switches.

It is further preferred if the free end of the switching member and the first end of the spring element are arranged on the same side of the join between spring element and switching member. An overall advantage of this design lies in the small space requirements: on the one hand, the "folded-over" arrangement of the countercontact with respect to the join between switching member and spring element requires smaller dimensions in the longitudinal direction. But small dimensions are also required transversely to the longitudinal direction, i.e. in the "switching direction." During the creep phase, the switching member tends to lift the movable contact element away from the countercontact, which is compensated for by a lowering of the joining point between spring element and switching member. When the switching member then snaps over, the joining point moves even farther in the direction of the countercontact, while simultaneously the movable contact is moved in the opposite direction. The distance between the attachment point of the spring element on the first external terminal and the countercontact is thus doubly utilized, so to speak, first for the compensation movement of the joining point between switching member and spring element during the creep phase of the switching member, and then to lift the movable contact element away from the countercontact.

The overall result of this design is a switch having a very low height and altogether requiring very little material, which in turn contributes to an economical switch.

It is further preferred if the first external terminal is joined to a connection electrode to which the spring element is attached with its first end; and if the second external terminal is preferably joined to a second connection electrode and the switching mechanism is arranged between the first and the second connection electrode.

This feature results in a very simple design, the reason being that only two connection electrodes, to be arranged parallel to one another, need to be provided, between which the switching mechanism is arranged by the fact that the spring element is attached with its first end to the one connection electrode, while the countercontact is provided on the other connection electrode.

Further advantages are evident from the description and the appended drawings.

It is understood that the features mentioned above and those yet to be explained below can be used not only in the respective combinations indicated, but also in other combinations or in isolation, without leaving the context of the present invention.

BRIEF DESCRIPTION OF THE DRAWINGS

Embodiments of the invention are depicted in the drawings and will be explained in more detail in the description below. In the drawings.

DETAILED DESCRIPTION OF PREFERRED EMBODIMENTS

Figure 1:
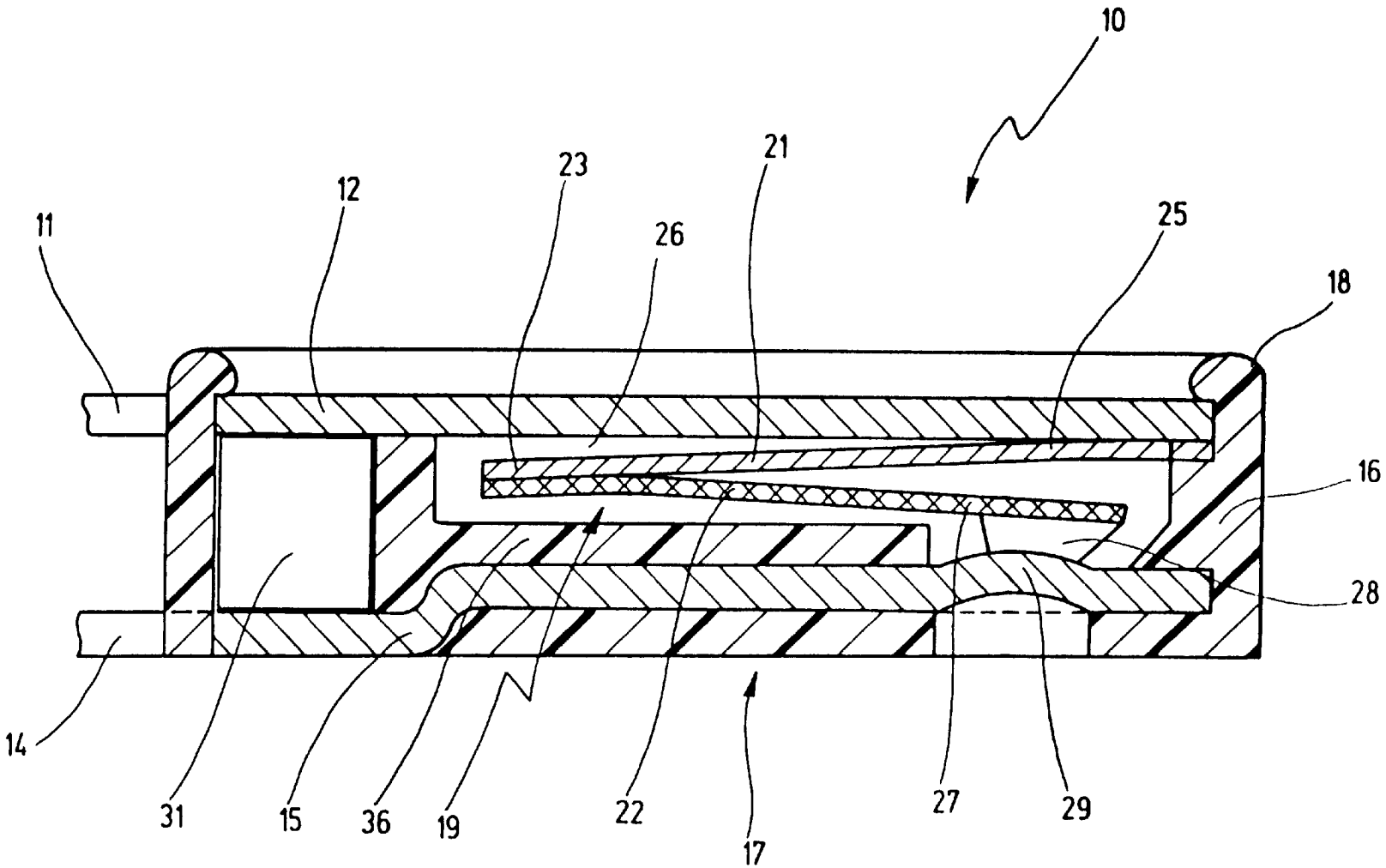
FIG. 1 shows a longitudinal section through a switch.

In FIG. 1, 10 generally designates a new switch which is depicted in schematic longitudinal section.

The new switch 10 has a first external terminal 11 which is joined integrally to a flat connection electrode 12. Also provided is a second external terminal 14 which is configured integrally with a second connection electrode 15. The two connection electrodes 12, 15 are held on an insulating support 16 which holds the two connection electrodes 12, 15 spaced apart parallel to one another.

While insulating support 16 can theoretically be open laterally, FIG. 1 shows an embodiment in which insulating support 16 comprises a cup-shaped lower housing part 17 which is configured around second connection electrode 15, by injection-embedding or encapsulation, in such a way that second connection electrode 15 is an integral part of lower housing part 17. Lower housing part 17 is closed off by first connection electrode 12, which for this purpose acts as cover part and is held in lossproof fashion by a hot-welded rim, indicated at 18, of insulating support 16.

Arranged between the two connection electrodes 12, 15 is a temperature-dependent switching mechanism 19 which comprises a mechanical and electrical series circuit made up of a spring element 21 and a switching member 22, which are joined to one another by a join indicated at 23. In the present case, switching member 22 is a bimetallic element.

Spring element 21 has a largely temperature-independent displacing force, which in the context of the present invention means that the displacing force or spring force of spring element 21 does not change appreciably within the permissible operating temperature range of switch 10. The displacing force of the bimetallic element, on the other hand, is highly temperature-dependent, and even in the so-called creep phase is already sufficient that spring element 21 cannot exert on the bimetallic element any pressure that impedes the deformation of the bimetallic element, which in this spring system is thus rigid at constant temperature.

Spring element 21 is attached with its first end 25 to first connection electrode 12 on the right in FIG. 1, and with its second end 26 leads into join 23 with switching member 22. Switching member 22 carries at its free end 27 a movable contact element 28 that coacts with a switch-mounted countercontact 29 that is configured on second connection electrode 15.

Also provided between the first and second connection electrodes 12, 15 is a PTC element, indicated at 31, which is arranged electrically in parallel with switching mechanism 19.

In its closed position shown in FIG. 1, switching mechanism 19 makes an electrically conductive connection between the two external terminals 11, 14, thereby short-circuiting PTC element 31. A current flowing through switch 10 passes from first external terminal 11 into first connection electrode 12 and from there via spring element 21 into switching member 22, from which it emerges via movable contact element 28 and then passes via countercontact 29 and second connection electrode 15 to second external terminal 14. If there is then an increase either in the temperature of switch 10 or switching member 22, and/or in the current flowing through switching member 22, switching member 22 moves into its open position (yet to be described) in which it lifts movable contact element 28 away from countercontact 29. The current flow through switching mechanism 19 is thereby interrupted, so that a residual current can now flow through PTC element 31. This residual current heats up PTC element 21 to the point that the temperature in switch 10 remains above the response temperature of switching member 22. In other words, PTC element 31 provides self-holding for switch 10 once it has opened.

Figure 2:
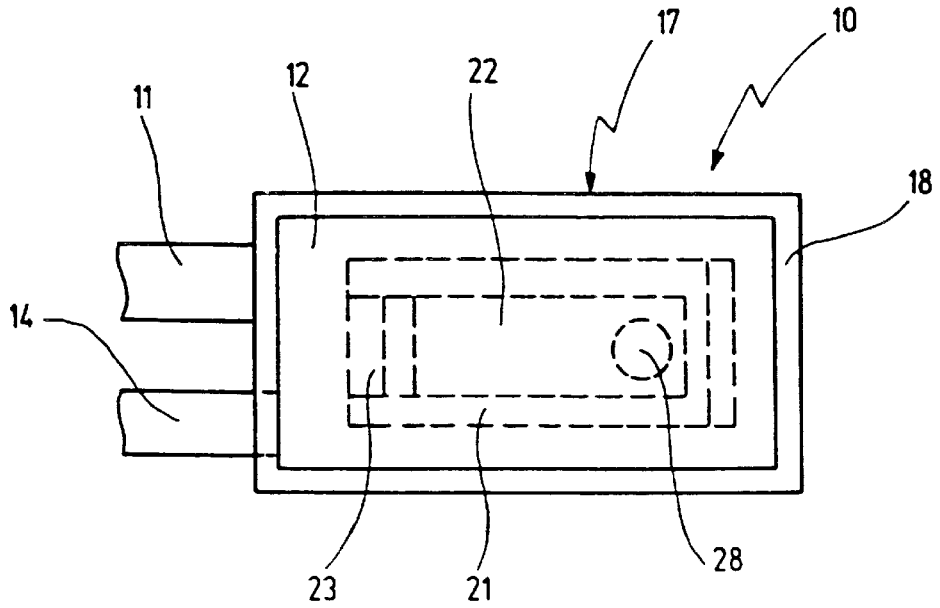
FIG. 2 shows a plan view of the switch according to FIG. 1.

FIG. 2 shows a plan view of the switch of FIG. 1, the first and second external terminals 11, 14 here being indicated not one below another as in FIG. 1, but next to one another. It is evident from FIG. 2 that rim 18 of lower housing part 17 completely surrounds first connection electrode 12, so that switch 10 is completely encapsulated.

It is further evident from FIG. 2 that both spring element 21 and switching member 22 are configured as elongated tongues which, in the plan view, are arranged one below another in such a way that both first end 25 of spring element 21 and free end 27 of switching member 22 are located next to join 23 to the right in FIG. 2.

Figure 3:
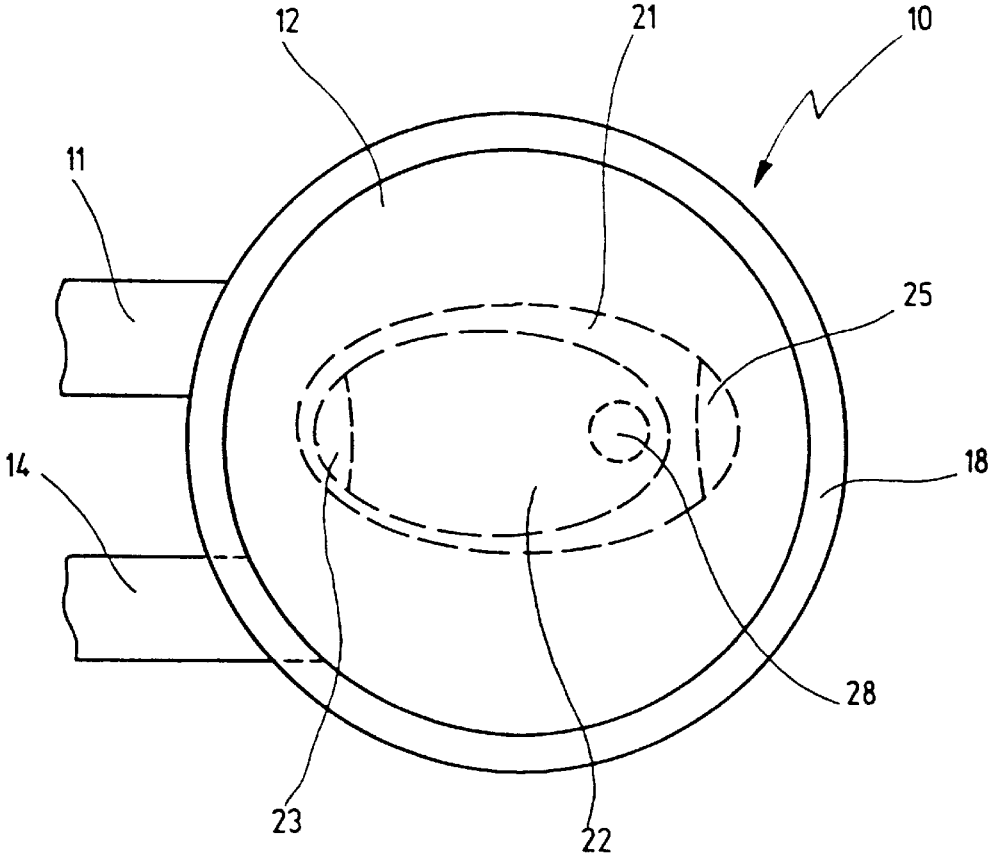
FIG. 3 shows a second embodiment of the switch, in a view like that of FIG. 2.

FIG. 3 shows a further switch 10 which has a rounded plan rather than the rectangular plan of FIG. 2. Otherwise, however, switch 10 of FIG. 3 corresponds to the configuration as shown in longitudinal section in FIG. 1, identical design features being labeled with the same reference characters. It should simply be mentioned that spring element 21 and switching member 22 are each configured as oval disks.

Leaving aside PTC element 31, which of course can be omitted whenever a self-hold function is not desired, the new switch 10 comprises four basic constituents, namely the two electrodes 12, 15 as well as spring element 21 and switching member 22. All four components can be stamped out from strip material and brought together for the purpose of automatic assembly. For this, join 23 is first produced by welding (FIG. 1) or crimping (FIGS. 4 through 6), whereupon spring element 21 is then welded at its first end 25 onto connection electrode 12. Because of the V-shaped configuration of the switching mechanism, free end 27 of switching member 22 thus ends up located above countercontact 29. It should also be mentioned here that movable contact part 28 can of course be dispensed with, but that contact part 28 provides for better contact resistance with respect to countercontact 29.

The two connection electrodes 12, 15 are then also attached to insulating support 16; it is possible to injection-mold lower housing part 17 around connection electrode 15 and then set connection electrode 12, with switching mechanism 19 attached thereto, in place from above, and attach it by way of a rim 18 that is hot-pressed.

Figure 4:
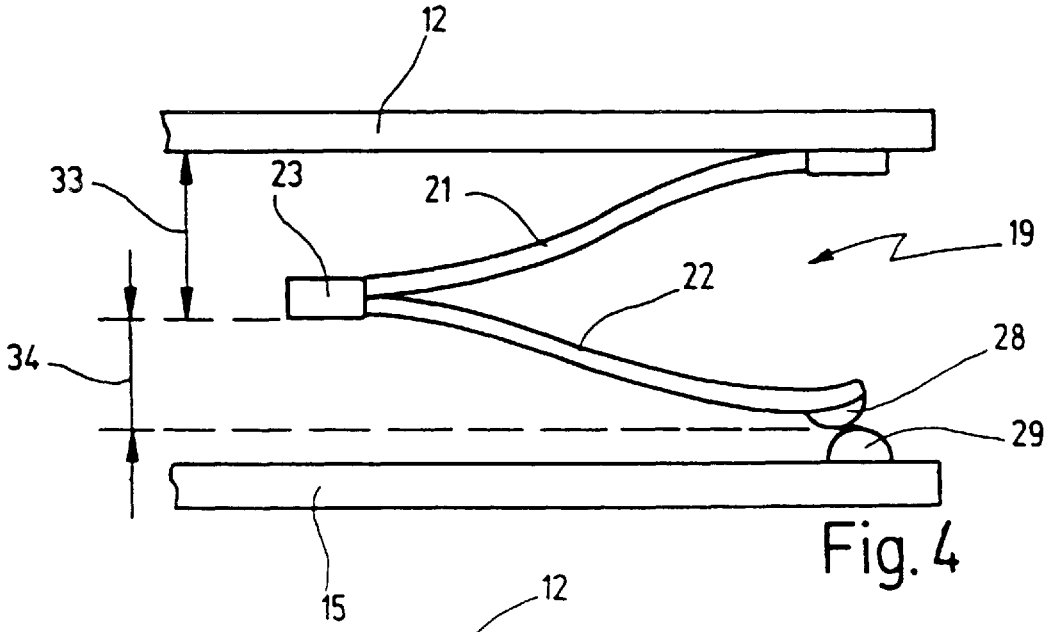
FIG. 4 shows the switching mechanism of the switch of FIG. 1 in a schematized, enlarged depiction, the switching member being in the closed position.

FIG. 4 schematically shows switching mechanism 19 of FIG. 1 at enlarged scale, in its closed position. Switching member 22 is so far below its kickover temperature that its creep phase has not yet begun. Switching member 22 presses join 23 upward in FIG. 4 against the force of spring element 21, thus resulting in a distance from first electrode 12 indicated at 33, and a distance from countercontact 29 indicated at 34.

Figure 5:
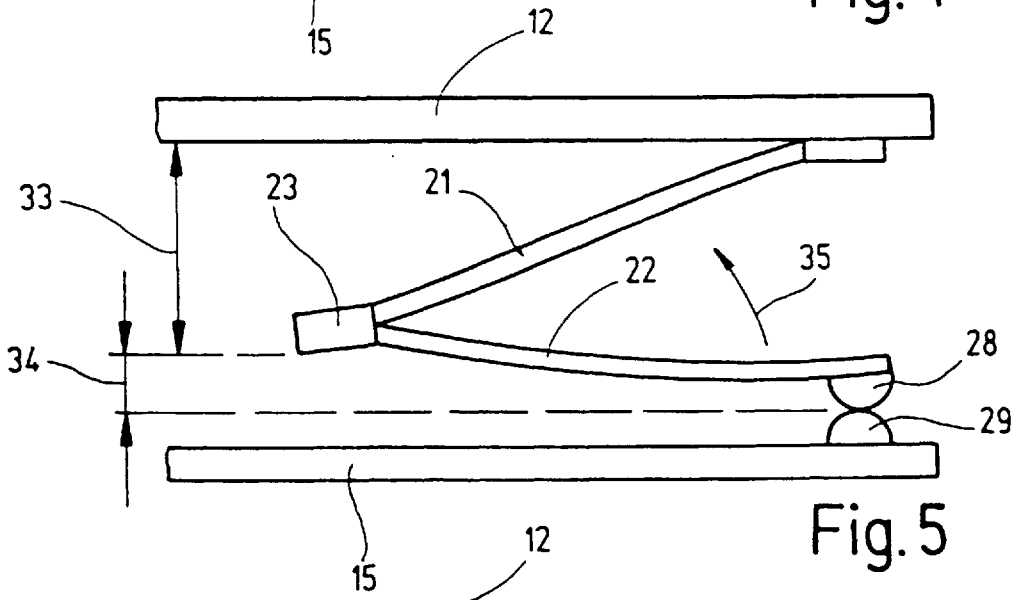
FIG. 5 shows a depiction like that of FIG. 4, but during the creep phase of the switching member.

If the temperature of switching member 22 then rises as a consequence of an increased current flow or an increased outside temperature, the creep phase of switching member 22 first begins, in which its spring force working against the force of spring element 21 weakens, so that join 23 is moved downward in FIG. 4, as depicted in FIG. 5. The displacing force of the bimetallic element is still so great, however, that the displacing force of spring element 21 is not sufficient to prevent the deformations which occur in the creep phase. Irrespective of its geometrical changes in the creep phase, the switching member may be regarded as rigid by comparison with spring element 21; and the contact pressure is exerted solely by the displacing force of the spring element.

Distance 33 becomes greater as distance 34 becomes less. The mechanical series circuit made up of spring element 21 and switching member 22, however, continues to press movable contact element 28 against countercontact 29. A comparison between FIGS. 4 and 5 reveals, however, that in FIG. 5, movable contact element 28 has shifted transversely with respect to countercontact 29. This friction is desirable, since the contact surfaces between contact element 28 and countercontact 29 are thereby cleaned, so that the electrical contact resistance is very low.

Figure 6:
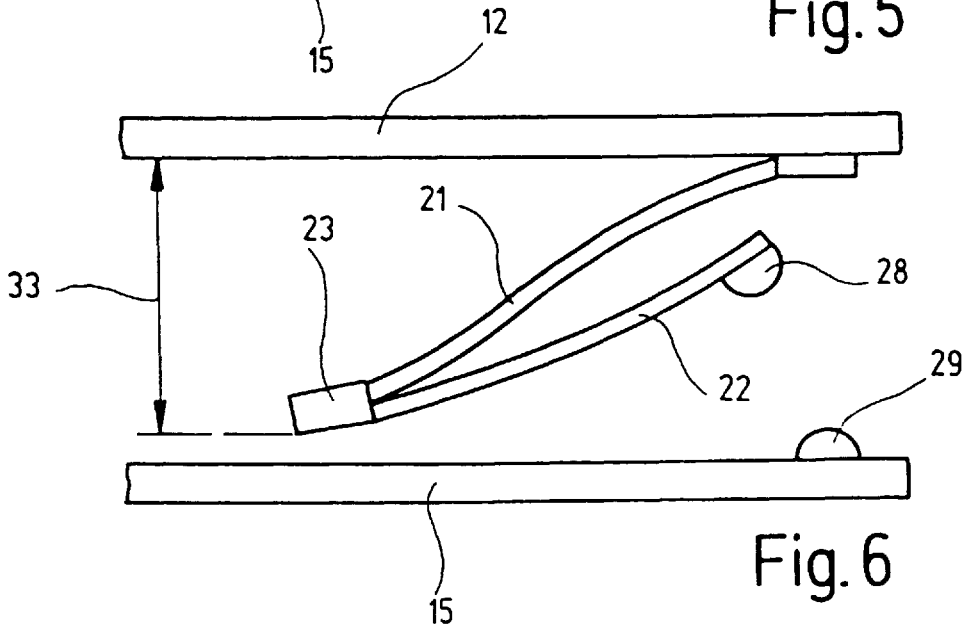
FIG. 6 shows a depiction like that of FIG. 4, with the switching member is in its open position.

If the temperature of switching member 22 then rises further, it snaps over in the direction of arrow 35 into its open position as depicted in FIG. 6. Join 23 moves even farther downward, while switching member 22 has lifted movable contact element 28 away from countercontact 29. A comparison between FIGS. 4 and 6 reveals that join 23 between connection electrodes 12, 15 moves downward, while movable contact element 28 moves upward in the opposite direction, so that the clearance between the two connection electrodes 12, 15 is, so to speak, doubly utilized.

In the position shown in FIG. 6, spring element 21 prevents any contact between join 23 and connection electrode 15. If it should be necessary for elasticity reasons to design the spring element so that it presses join 23 in FIG. 6 onto connection electrode 15, an insulating element can be provided between join 23 and connection electrode 15, as indicated in FIG. 1 at 36. When switching member 22 moves into its open position in FIG. 1, spring element 21 presses join 23 onto insulating element 36, which thus prevents any contact with connection electrode 15.

Figure 7:
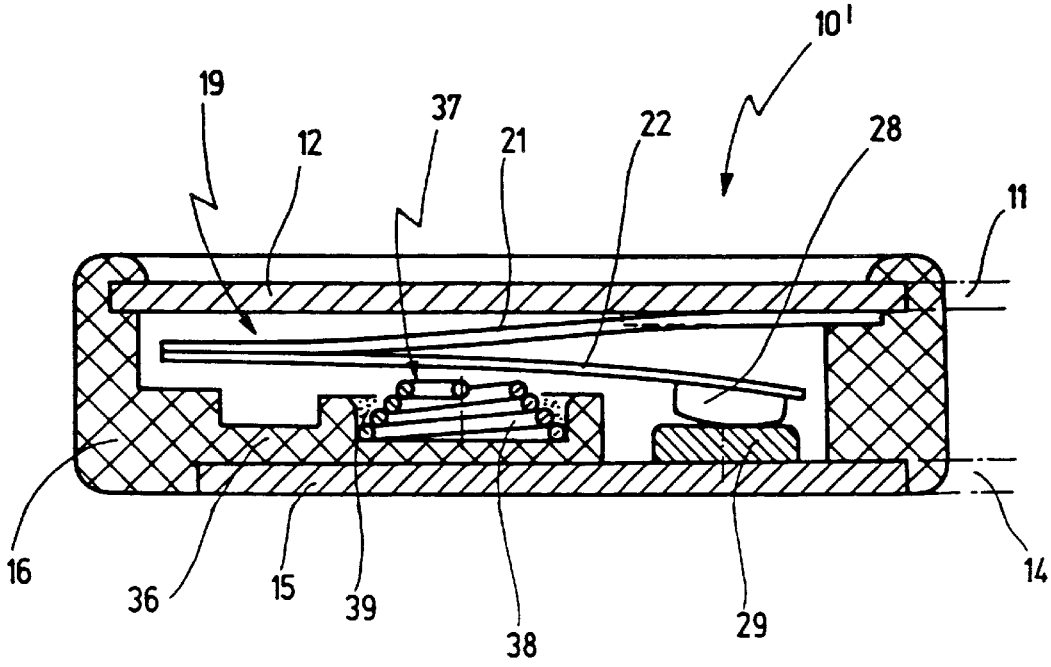
FIG. 7 shows a switch like that of FIG. 1, but with a safety element according to the invention and in closed condition.

FIG. 7 shows, in a representation similar to that of FIG. 1, a new switch with a safety element 37. Safety element 37 is constituted by a compression spring 38, which in its compressed condition is retained in position by fusible solder, indicated at 36. Compression spring 38 sits in a cup-shaped depression 41 on insulating element 36, known from FIG. 1, and is retained either by clamping or gluing.

Besides, switch 10', as illustrated in FIG. 7, corresponds to switch 10 in FIG. 1, except that external terminals 11 and 12 project to the right in FIG. 7, a further difference lying in the fact that the second connection electrode 15 forms the flat bottom of switch 10'. Besides, the operation of switch 10' is the same as described in connection with FIGS. 1 and 6, where compression spring 38 was initially disregarded for the sake of clarity, with the exception that the PCT element 31 is missing.

Now, when the temperature of switch 10' rises to a safety temperature above the response temperature of switching member 22, fusible solder 39 will liquefy and, thus, permit compression spring 38 to relax. This condition is illustrated in FIG. 8.

Figure 8:
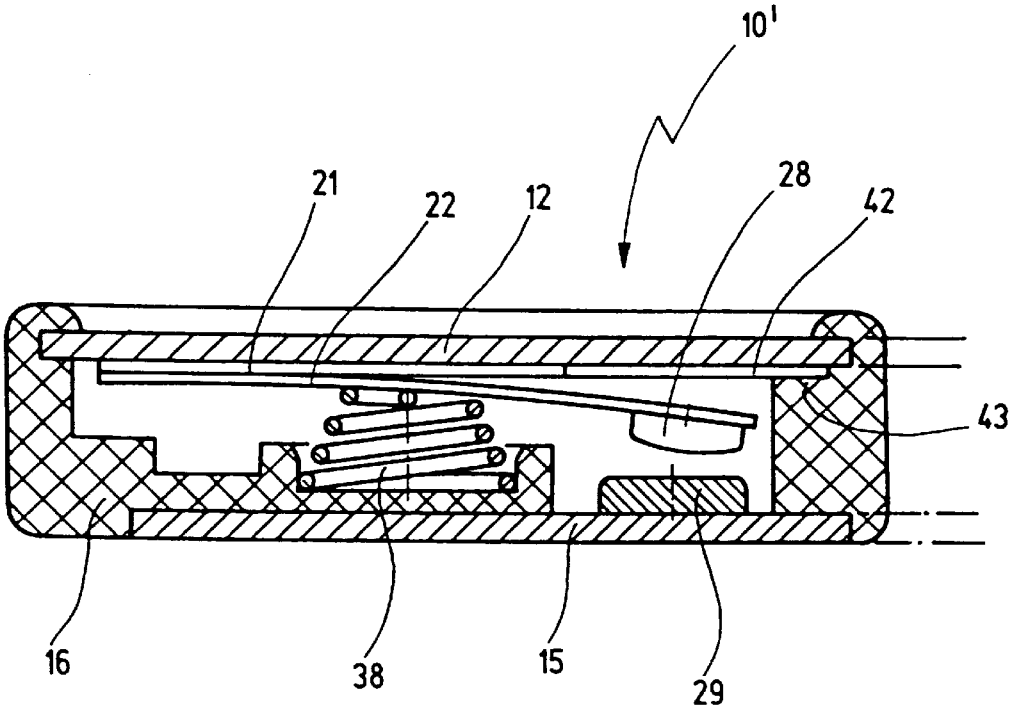
FIG. 8 shows the switch of FIG. 7 in the open condition provoked by the safety element.

FIG. 8 shows that compression spring 38 is operatively positioned between second connection electrode 15 and spring element 21 and/or switching member 22 and urges, in its relaxed condition, spring element 21 against upper connection electrode 12. The displacing force of compression spring 38 need not be high enough to bring switching member 22 into flat contact with upper connection electrode 12; the fact that the small displacing force of spring element 21 is overcome already ensures that movable contact element 28 is permanently lifted off from countercontact 29.

As a further particularity of the design of switch 10' it should be mentioned that spring element 21 comprises lateral wings 42 by means of which it rests on a shoulder 43 of insulating support 16, as can be seen best in FIG. 1, which shows a plan view of switch 10' in a representation similar to that of FIG. 2.

Figure 9:
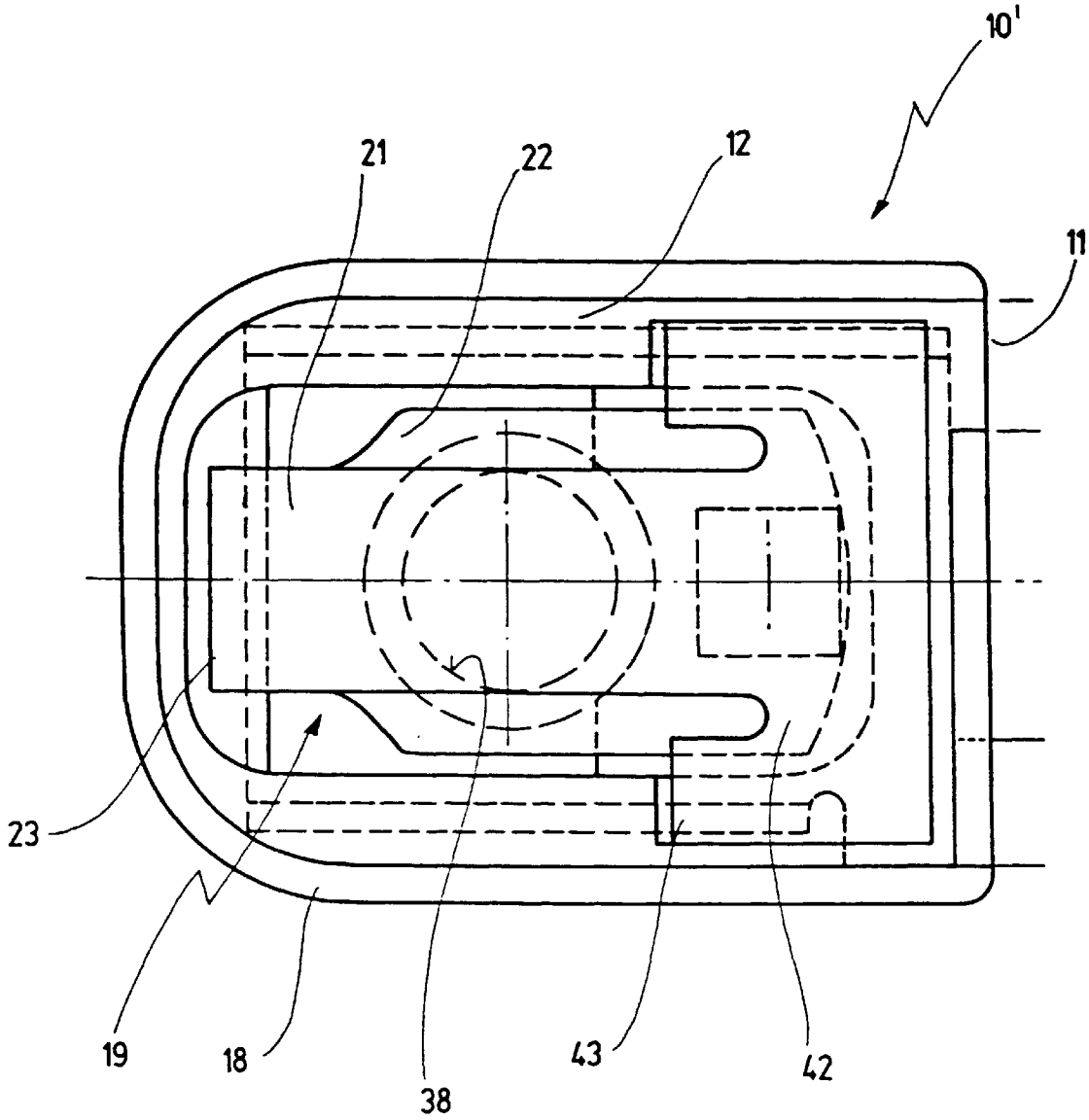
FIG. 9 shows a plan view of the switch according to FIG. 7.

In FIG. 9, comparable functional elements are indicated by the same reference numerals as in FIG. 2, so that reference is made generally to the description of FIG. 2.

By clamping wings 42 between upper connection electrode 15 and shoulder 43 of the insulating support 16, one achieves a simple contact action for switching mechanism 19, which comprises spring element 21, switching member 22 and movable contact 28 and which can be both mechanically fixed inside switch 10', and electrically connected with the first external terminal by a single operation, during hot-pressing of rim 18, so that the final assembly of the new switch 10' is indeed very simple.

Following or during injection molding of insulating support 18, lower connection electrode 15, with the housing-mounted countercontact 29 mounted thereon, is fixed to insulating support 16 for example by injection-embedding or encapsulation. Thereafter, compression spring 38, being compressed by fusible solder 39, is fitted in recess 41 and retained in it by clamping or gluing. As a next step, switching mechanism 19, comprising spring element 21 and switching member 22 with movable contact element 28, is placed in the cup-shaped housing, with wings 42 resting on shoulder 43. Now, first connection electrode 12 is placed on insulating support 16 from above, and rim 18 is hot-pressed, thereby establishing the mechanical connection and the electric connection of the switching mechanism.

Figure 10:
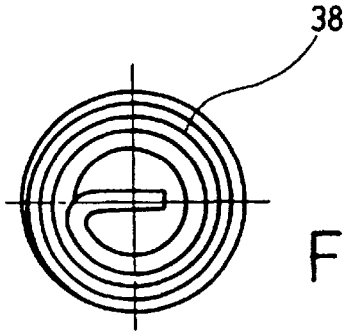
FIG. 10 shows a plan view of the safety element of the switch according to FIG. 7.

Finally, reference is made to FIG. 10 which shows a plan view of compression spring 38.

Therefore, what I claim, is:

1. A switch having a first and at least a second external terminal, and a temperature-dependent switching mechanism that makes, as a function of its temperature, an electrically conductive connection between the first and second external terminals, the switching mechanism comprising a switching member which changes its geometrical shape between a closed position and an open position as a function of temperature and, in its closed position, carries the current flowing through the switch, as well as an actuating member which is permanently connected electrically and mechanically in series with the switching member, the switching member opening and closing the switch as a function of temperature, wherein the switch comprises a safety element which, when a given safety temperature is exceeded for the first time, keeps the switch in its open condition irrespective of its subsequent temperature.

2. The switch of claim 1, wherein the switching member comprises a spring element whose displacing force is largely temperature-independent, and wherein the switching member has a temperature-dependent displacing force higher, in a creeping phase, than the displacing force of the spring element.

3. The switch of claim 2, wherein the switching member comprises a bimetallic element.

4. The switch of claim 2, wherein the switching member comprises a trimetallic element.

5. The switch of claim 2, wherein the spring element is joined at a first end to the first external terminal and at a second end to the switching member.

6. The switch of claim 5, wherein in its closed position a free end of the switching member is pressed by the spring element against a countercontact joined to the second external terminal, and in its open position the switching member lifts its free end away from the countercontact.

7. The switch of claim 6, wherein the countercontact is arranged integrally with the switch.

8. The switch of claim 6, wherein the free end of the switching member and the first end of the spring element are arranged on the same side of a join between spring element and switching member.

9. The switch of claim 2, wherein the first external terminal is joined to a connection electrode to which the spring element is attached with its first end.

10. The switch according to claim 2, wherein the second external terminal is joined to a second connection electrode and the switching mechanism is arranged between the first and the second connection electrode.

11. The switch of claim 1, wherein the safety element is a compression spring that acts on the actuating member.

12. The switch of claim 2, wherein the safety element is a compression spring that acts on the actuating member.

13. The switch of claim 6, wherein the safety element is a compression spring that acts on the actuating member.

14. The switch of claim 13, wherein the compression spring is operatively positioned between the countercontact and the switching member.

15. The switch of claim 11, wherein the compression spring is in its compressed condition before the safety temperature is exceeded for the first time, and is retained in that position by fusible solder, which liquefies after the safety temperature has been reached so that the compression spring is permitted to relax.

16. The switch of claim 14, wherein the compression spring is in its compressed condition before the safety temperature is exceeded for the first time, and is retained in that position by fusible solder, which liquefies after the safety temperature has been reached so that the compression spring is permitted to relax.

17. The switch of claim 10, wherein the safety element is a compression spring that acts on the actuating member.

18. The switch of claim 17, wherein one end of the compression spring rests on the second connection electrode, via an insulating element, while its other end gets into contact with the switching member when the safety temperature is exceeded.

19. A switch having a first and at least a second external terminal, and a temperature-dependent switching mechanism that makes, as a function of its temperature, an electrically conductive connection between the first and second external terminals, the switching mechanism comprising a switching member which changes its geometrical shape between a closed position and an open position as a function of temperature and, in its closed position, carries the current flowing through the switch, and an actuating member which is permanently connected electrically and mechanically in series with the switching member, wherein the switch comprises a safety element which, when a given safety temperature is exceeded for the first time, keeps the switch in its open condition irrespective of its subsequent temperature, and wherein the actuating member comprises a spring element whose displacing force is largely temperature-independent, and wherein the switching member has a creeping phase and a temperature-dependent displacing force that is higher than the displacing force of the spring element, when the switching member is in the creeping phase.

20. A switch having a first and at least a second external terminal, and a temperature-dependent switching mechanism that makes, as a function of its temperature, an electrically conductive connection between the first and second external terminals, the switching mechanism comprising a switching member which changes its geometrical shape between a closed position and an open position as a function of temperature and, in its closed position, carries the current flowing through the switch, and an actuating member which is permanently connected electrically and mechanically in series with the switching member, wherein the switch comprises a safety element which, when a given safety temperature is exceeded for the first time, keeps the switch in its open condition irrespective of its subsequent temperature, and wherein the safety element is a compression spring that acts on the actuating member, and wherein the compression spring is in its compressed condition before the safety temperature is exceeded for the first time, and is retained in that position by fusible solder, which liquefies after the safety temperature has been reached so that the compression spring is permitted to relax.

* * * * *

UNITED STATES PATENT AND TRADEMARK OFFICE

CERTIFICATE OF CORRECTION

PATENT NO. : 6,191,680 B1
DATED : February 20, 2001
INVENTOR(S) : Marcel Hofsäss It is certified that error appears in the above-identified patent and that said Letters Patent is hereby corrected as shown below:

Column 12,
Lines 5, 7, 9, 23, 26 and 32, "claim 2" should be -- claim 19 --.

Signed and Sealed this

First Day of July, 2003

JAMES E. ROGAN
*Director of the United States Patent and Trademark Office*